US007823992B2

(12) United States Patent
Chen et al.

(10) Patent No.: US 7,823,992 B2
(45) Date of Patent: Nov. 2, 2010

(54) DRAWER INTERLOCK MECHANISM

(75) Inventors: Ken-Ching Chen, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 495 days.

(21) Appl. No.: 12/000,942

(22) Filed: Dec. 19, 2007

(65) Prior Publication Data

US 2009/0160298 A1 Jun. 25, 2009

(51) Int. Cl.
*E05C 7/06* (2006.01)
*E05C 9/10* (2006.01)

(52) U.S. Cl. ..... 312/221; 312/216

(58) Field of Classification Search ..... 312/215–222
See application file for complete search history.

(56) References Cited

U.S. PATENT DOCUMENTS 3,404,929 A * 10/1968 Wright et al. ..... 312/216
3,791,708 A * 2/1974 Signore ..... 312/221
3,883,200 A * 5/1975 Latham ..... 312/216
4,239,309 A * 12/1980 De Fouw et al. ..... 312/221
4,298,236 A * 11/1981 Laroche ..... 312/215
4,396,239 A * 8/1983 Wissman ..... 312/216
5,199,774 A * 4/1993 Hedinger et al. ..... 312/219
5,599,078 A * 2/1997 Dechene et al. ..... 312/221
5,671,985 A * 9/1997 Grieser et al. ..... 312/221
6,082,839 A 7/2000 Chiku
6,109,708 A 8/2000 Walla et al.
6,568,771 B2 5/2003 Gentili et al.
6,634,726 B1 10/2003 Slivon
6,637,843 B2 10/2003 Westwinkel
6,722,749 B1 4/2004 Pagac
6,726,294 B1 4/2004 Muller et al.
6,742,854 B2 6/2004 Chen
6,749,274 B2 6/2004 Westwinkel
6,779,855 B2 8/2004 Hoffman
6,896,342 B1 5/2005 Cheng
6,966,619 B2 11/2005 Muller
7,140,700 B2 11/2006 Dube et al.
7,144,092 B1 12/2006 Chang

* cited by examiner

*Primary Examiner*—Janet M Wilkens
*Assistant Examiner*—Timothy M Ayres
(74) *Attorney, Agent, or Firm*—Rosenberg, Klein & Lee

(57) ABSTRACT

A drawer interlock mechanism includes at least two drawers, a fixture, a linking frame, locking members and guiding members. The drawers may be pulled in and out. The drawers are lined straight with each other. The fixture is disposed at one side the drawers, and is formed with slots corresponding in position and in number to the guiding members. The linking frame is disposed on the fixture. Each guiding member is secured to the side of each drawer. When one of the drawers is open, the guiding member of the open drawer will link the relative locking member to move the linking frame, which then links the other locking members. The guiding member of the open drawer triggers the relative locking member to lock the linking frame temporarily, and the other locking members block their relative guiding members so that the other drawers are unable to slide.

3 Claims, 11 Drawing Sheets

DRAWER INTERLOCK MECHANISM

BACKGROUND OF THE INVENTION

1. Field of the Invention

The present invention relates to a drawer interlock mechanism, and more particularly to a locking mechanism applied to a cabinet having multiple drawers. When one of the drawers is open, the other drawers will be locked from opening.

2. Description of the Prior Art

A conventional cabinet comprises a design which protects the cabinet from falling when the drawer is loaded with heavy stuff. The restriction is to limit one drawer to be opened at a time. A rack-mounted computer system is provided with a computer frame inside to beautify the atmosphere. The weight of the computer may cause the cabinet tilting or tipping towards one side, thus, is anti-tip and anti-tilt consideration is brought to the public's attention.

In view of the above shortcomings, interlock devices are delivered and have been patented by the US PTO.

SUMMARY OF THE INVENTION

A drawer interlock mechanism according to the present invention restricts all drawers to be open at the same time, and has made improvement in a whole, thus this corresponds to the novelty different from all of the previous techniques.

According to the present invention, there is provided a drawer interlock mechanism, comprising:

at last two drawers, said drawers corresponding with each other in an upper and lower position and enabling to slide in and out;

a fixture, said fixture being disposed at one side of said drawers and having longitudinal slots, each said slot having a locating trough at a center portion thereof, said locating trough interconnecting with said slot;

a linking frame, said linking frame being disposed on said fixture and moving up and down with respect to said fixture;

locking members, said locking members being connected to said linking frame and corresponding in position to said slots of said fixture, each said locking member comprising a plate, a stick, a driven protuberance and a protuberance, said plate having a first end and a second end, said stick being pivoted to said plate and located between said first end and said second end of said plate, said plate being rotatable with respect to said stick, one end of said stick being fixedly connected to said linking frame, said driven protuberance being disposed on said first end of said plate and having an upper section and a lower section, said protuberance being disposed on said second end of said plate and sliding in said slot and said locating trough; and guiding members driven by said drawers, each said guiding member comprising a guiding board, a first clip, a second clip, a first blocking board, and a second blocking board, said guiding board having a lower first end and an upper second end and engaging with said stick of said locking member, said first clip and said second clip being spaced and located nearby said second end of said guiding board, said first clip engaging with said upper section of said driven protuberance of said locking member, said second clip engaging with said lower section of said driven protuberance of said locking member, said first blocking board and said second blocking board being disposed nearby said first end of said guiding board and corresponding to respective sides on top of said driven protuberance, when said locking member is linked by said linking frame to rise, said second blocking board blocking said driven protuberance to keep said locking member in a straight position with respect to said slot of said fixture, and said first blocking board blocking said stick of said locking member.

Preferably, said guiding members are secured to the side of said drawers.

Preferably, said drawers are mounted to a sliding device, said guiding members being secured to said sliding device.

In view of the above, the present invention has the merit of providing a drawer interlock mechanism which works accurately without malfunction consideration.

DETAILED DESCRIPTION OF THE PREFERRED EMBODIMENT

Figure 1:
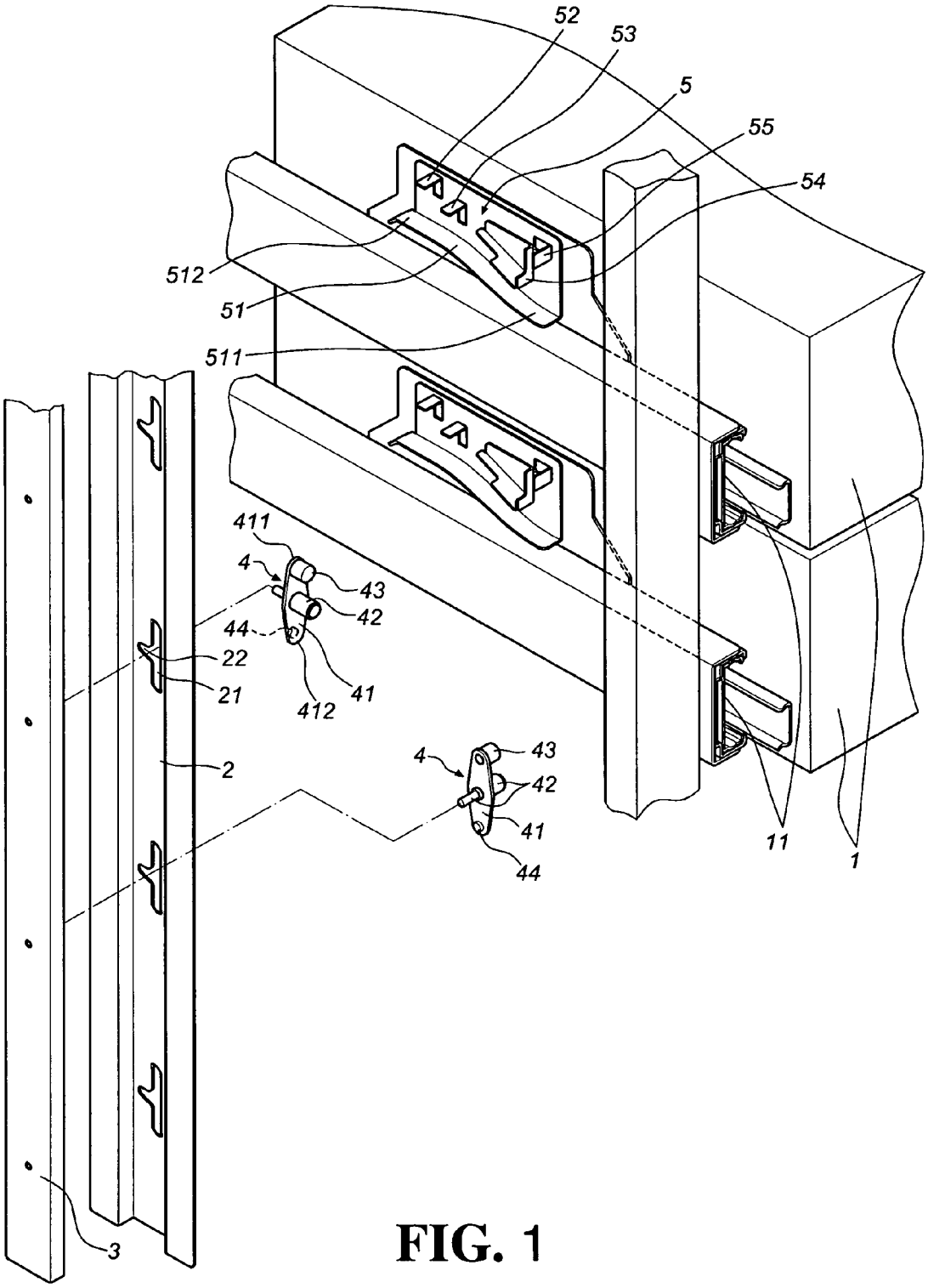
FIG. 1 is an exploded view of the present invention.
Figure 2:
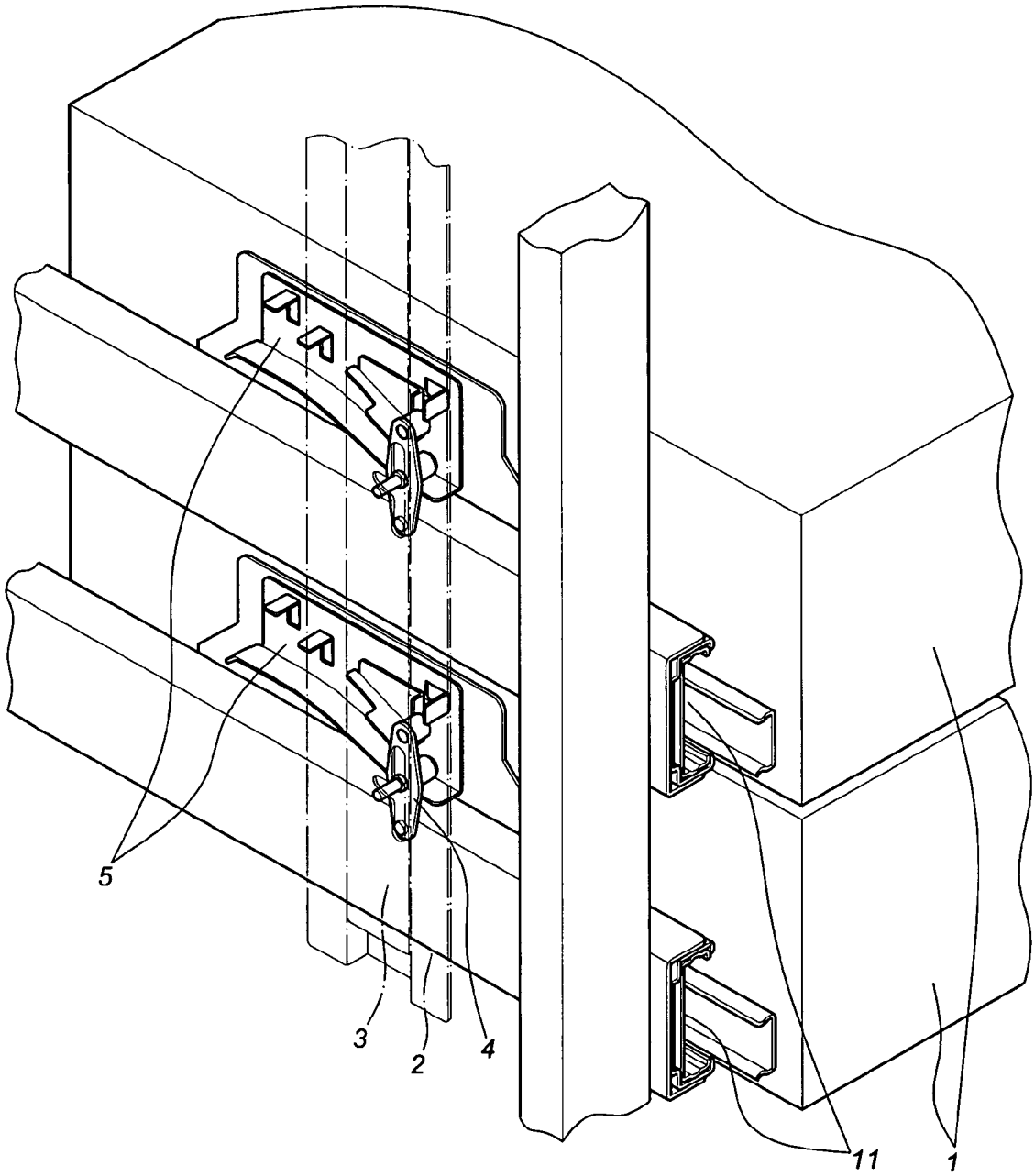
FIG. 2 is a perspective view of the present invention.
Figure 3:
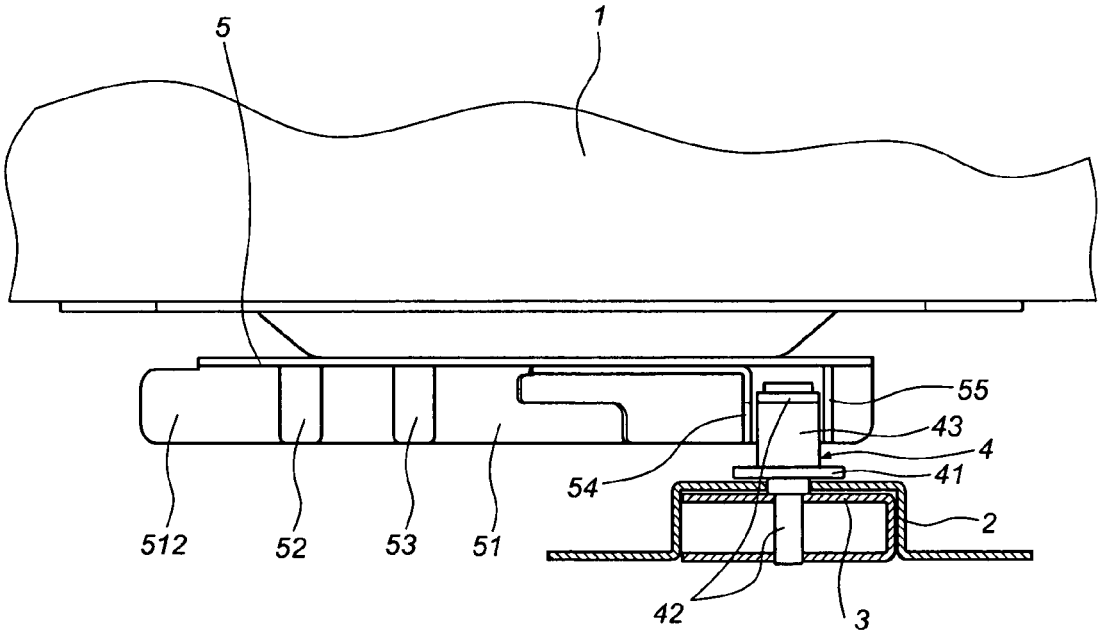
FIG. 3 is a cross-sectional view of the present invention, showing the relationship among a drawer, a slide assembly, a guiding member, a fixture, a locking member and a linking frame of the present invention.

As shown in FIGS. 1 through 3, a preferred embodiment of the present invention comprises at least two drawers 1, a fixture 2, a linking frame 3, locking members 4, and guiding members 5.

The drawers 1 correspond with each other in an upper and lower position and enable to slide in and out. Each drawer 1 has two sides relative to the front and rear of the drawer. Each drawer 1 is mounted on a sliding device, such as a slide assembly 11.

The fixture 2 is disposed at one side of the drawers 1. The fixture 2 is formed with longitudinal slots 21 corresponding in position and in number to the locking members 4. Each slot 21 has its center portion interconnected to a locating trough 22 which has an arcuate shape at a lower end thereof.

The linking frame 3 is disposed on the fixture 2 and is able to move up and down with respect to the fixture 2.

Figure 4:
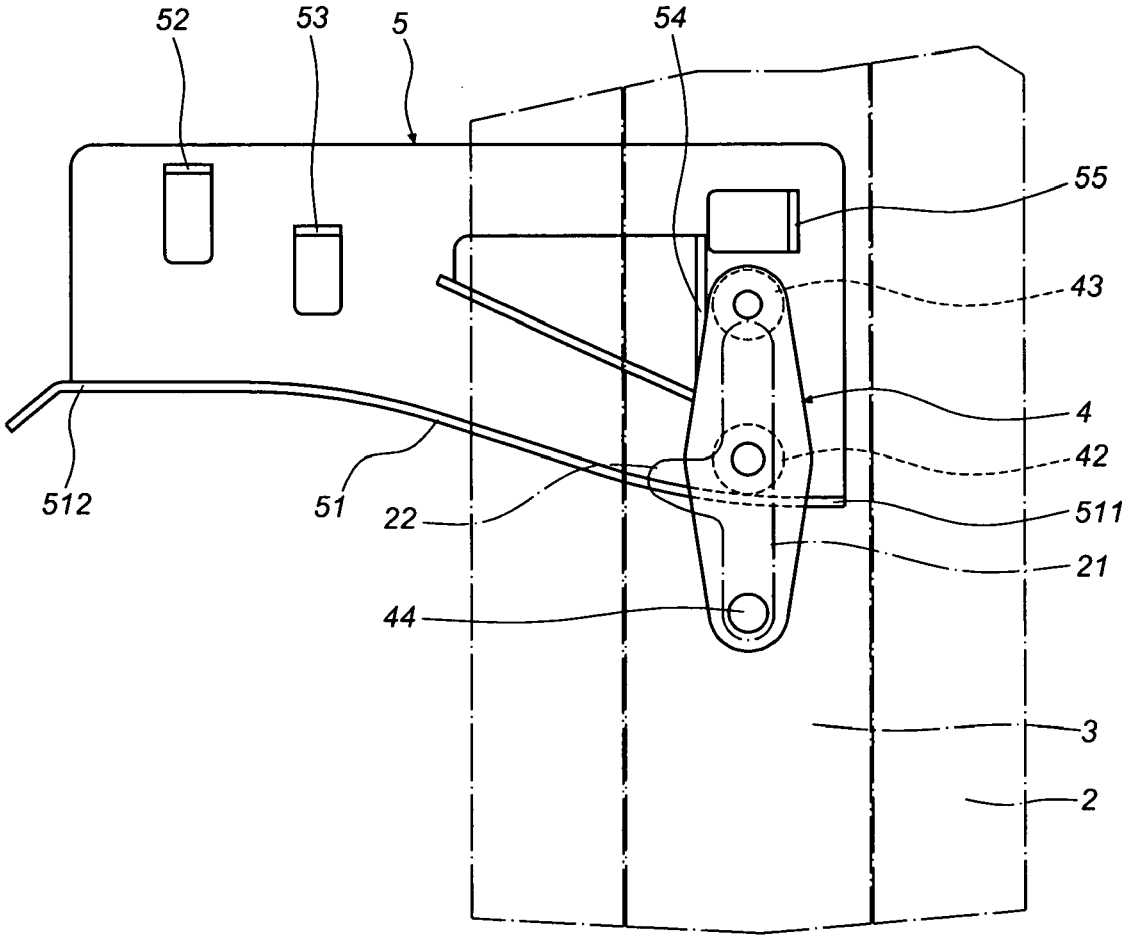
FIG. 4 is a partial sectional view of the corresponding position among the fixture, the locking member and the guiding member of the present invention.
Figure 8:
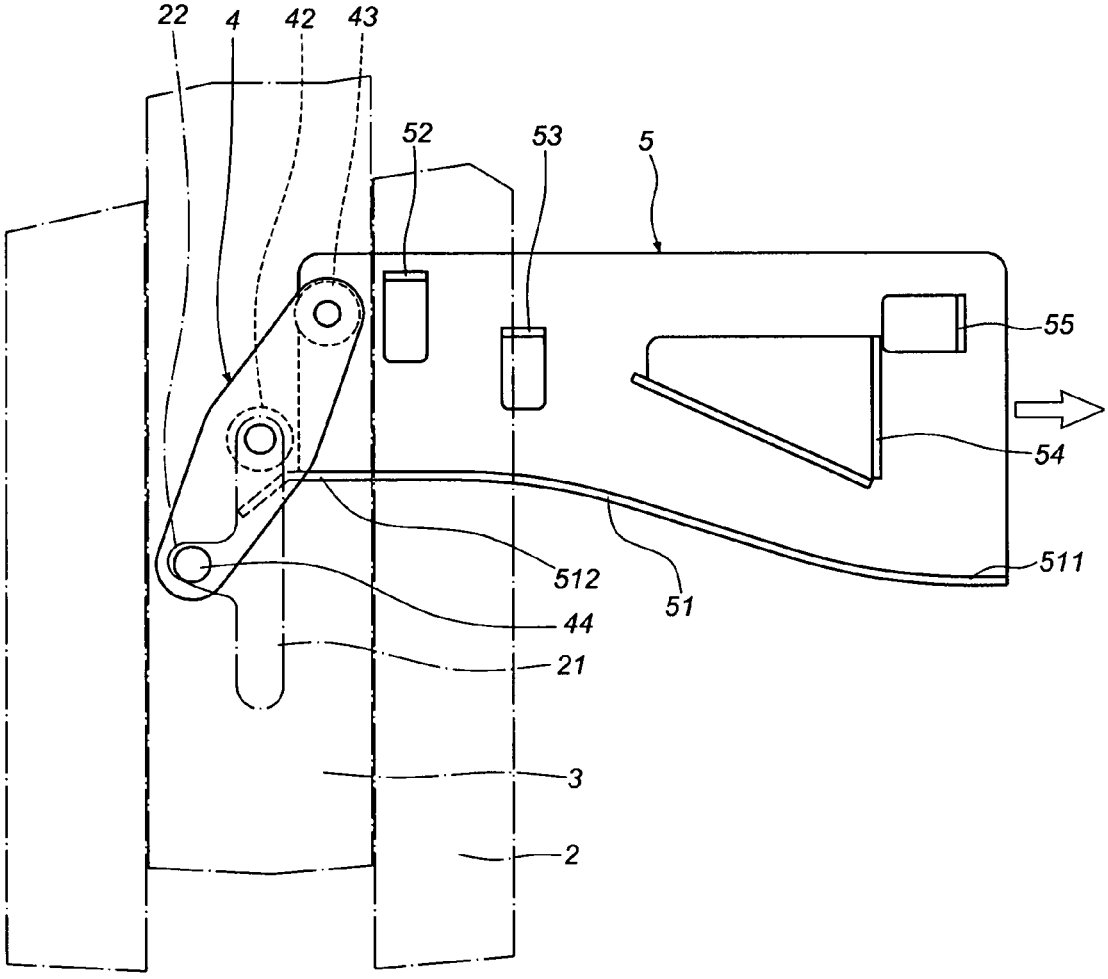
FIG. 8 is a view showing the fixture, the locking member and the guiding member in a second locked position.

The locking members 4 corresponding in position to the slots 21 of the fixture 2 are connected to the linking frame 3. Each locking member 4 comprises a plate 41, a stick 42, a driven protuberance 43, and a protuberance 44. The plate 41 has a first end 411 and a second end 412. The stick 42 is pivoted to the plate 41 and located between the first end 411 and the second end 412. The plate 41 is rotatable with respect to the stick 42. One end of the stick 42 is fixedly connected to the linking frame 3. The driven protuberance 43 is disposed on the first end 411 of the plate 41 and has an upper section and a lower section. The protuberance 44 is disposed on the second end 412 of the plate 41 and slides in the slot 21 and the locating trough 22, as shown in FIGS. 4 and 8.

The fixture 2 in this embodiment has a U-shaped cross-section with the linking frame 3 secured thereon. The locking member 4 is located at the other side of the fixture 2 with the stick 42 extending through the slot 21 and pivoted to the linking frame 3. All the locking members 4 are linked with the linking frame 3, and the linking frame 3 is able to slide up and down with respect to the fixture 2.

The guiding member 5 is secured to the side of the drawer 1 either directly or indirectly. In this embodiment, the guiding member 5 is fixedly connected to the sliding device so as to link the drawer 1 to move along with the slide assembly 11. The guiding member 5 comprises a guiding board 51, a first clip 52, a second clip 53, a first blocking board 54, and a second blocking board 55. The guiding board 51 has a lower first end 511 and a higher second end 512. As shown in FIGS. 4 through 8, the guiding board 51 is adapted to engage with the stick 42. The first clip 52 and the second clip 53 are spaced and located nearby the second end 512 of the guiding board 51. The first clip 52 engages with the upper section of the driven protuberance 43 of the locking member 4 while the second clip 53 engages with the lower section of the driven protuberance 43 of the locking member 4 in an operation status. The first blocking board 54 and the second blocking board 55 are located nearby the first end 511 of the guiding board 51, and correspond in position to respective sides on top of the driven protuberance 43. When the locking member 4 is brought by the linking frame 3 to move upward, the second blocking board 55 will block the driven protuberance 43. The locking member 4 is remained straight with respect to the slot 21 of the fixture 2, and the first blocking board 54 blocks the stick 42 of the locking member 4.

Figure 9:
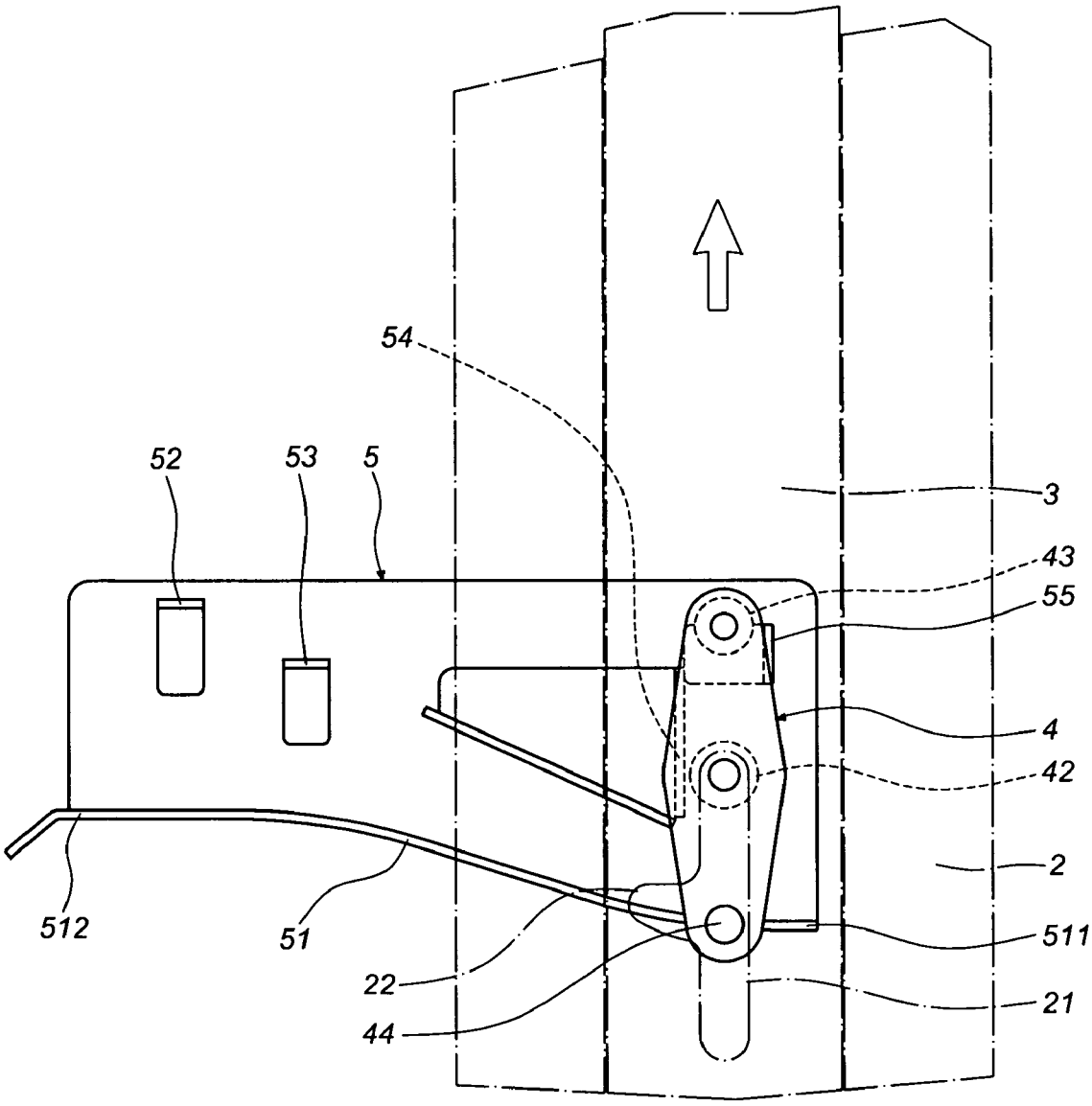
FIG. 9 is a view showing the fixture, the locking member and the guiding member in a third locked position.
Figure 10:
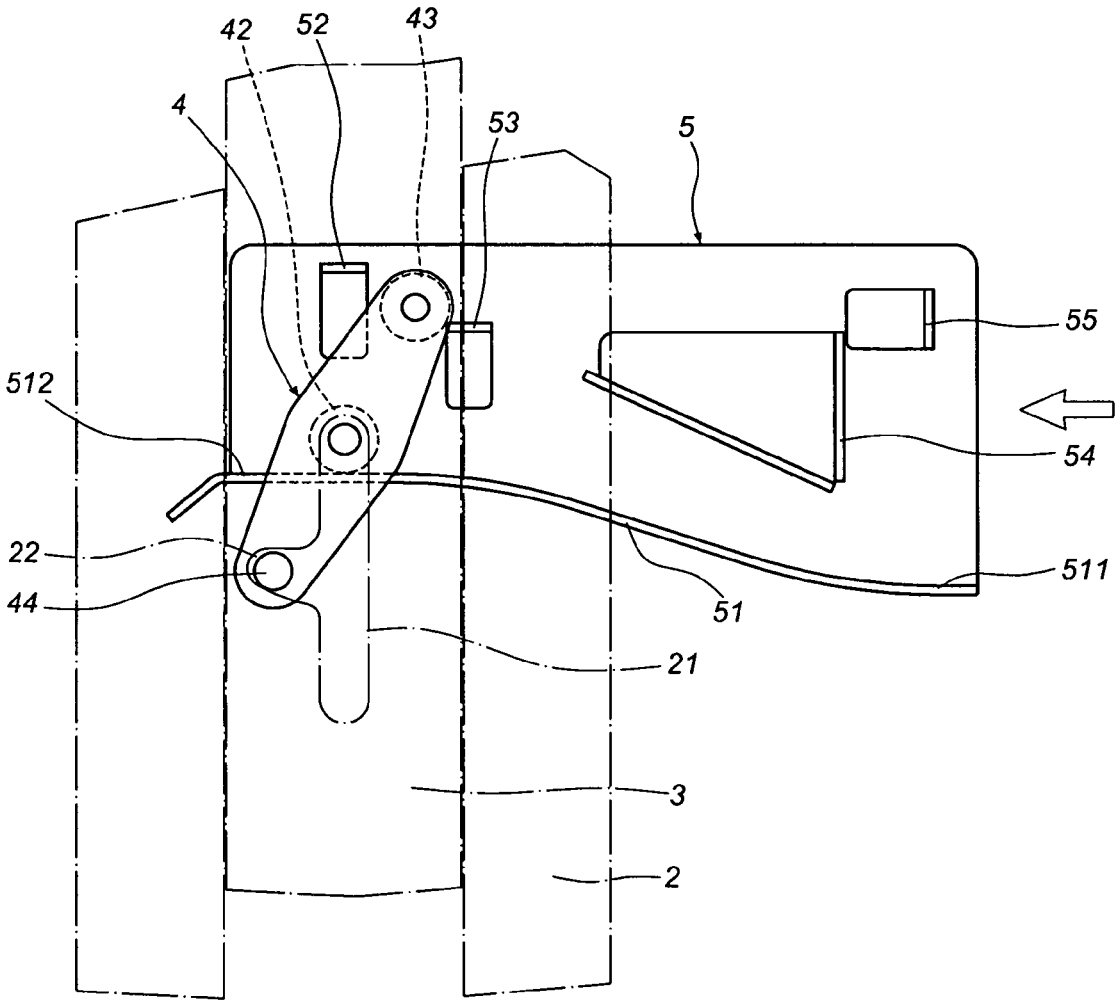
FIG. 10 is a view showing the fixture, the locking member and the guiding member in a first unlocked position.
Figure 11:
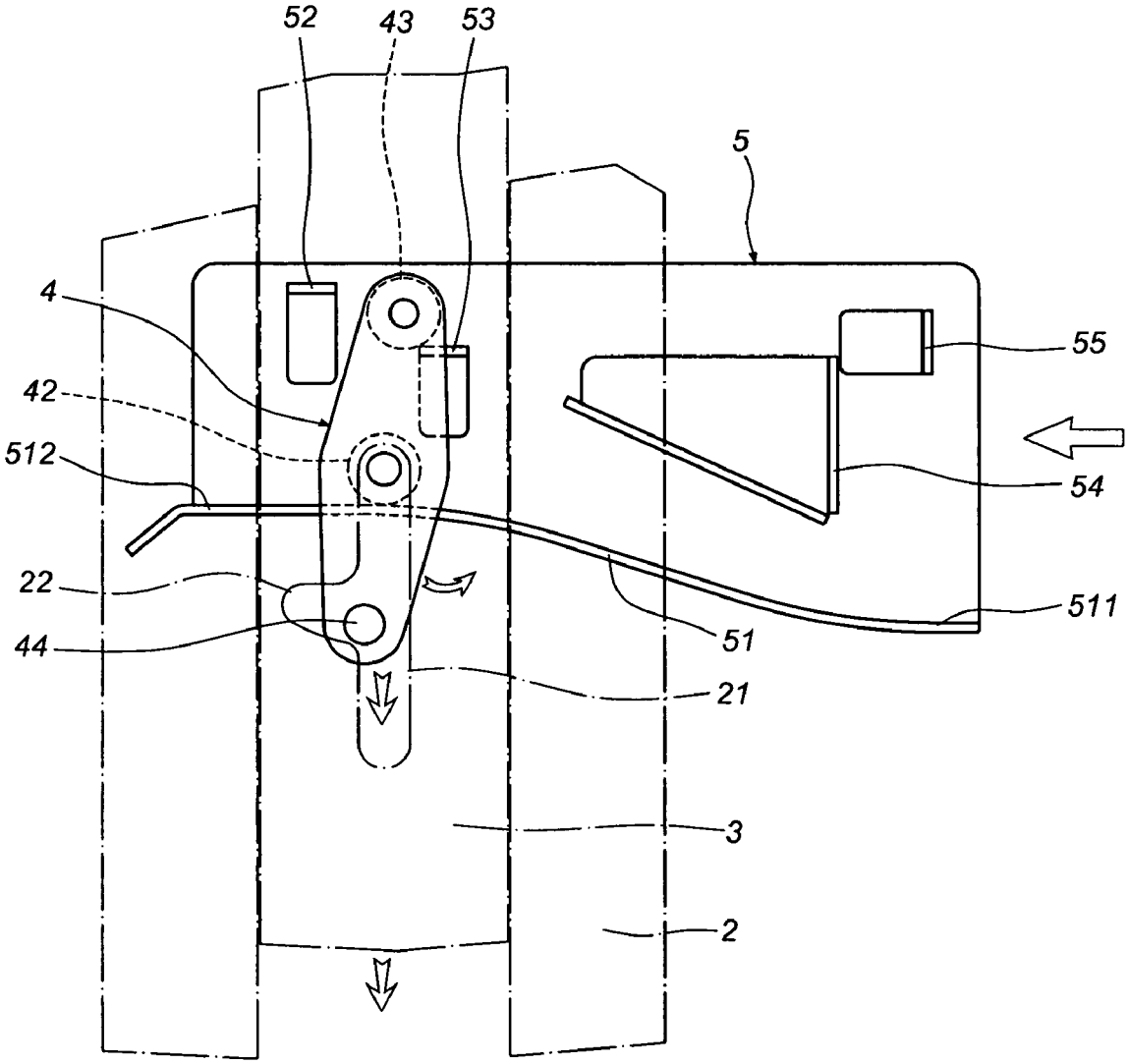
FIG. 11 is a view showing the fixture, the locking member and the guiding member in a second unlocked position

FIG. 2 is a perspective view of the present invention after assembled. FIG. 3 is a cross-sectional view of the present invention after assembled. As shown in FIG. 4, all of the drawers 1 of the present invention are in a closed position. As shown in FIGS. 5 through 8, the present invention is in an operation status. As shown in FIG. 9, one of the drawers 1 is open and the other drawers 1 are in a locked position. As shown in FIGS. 10 and 11, the present invention is in an unlocked position.

Figure 5:
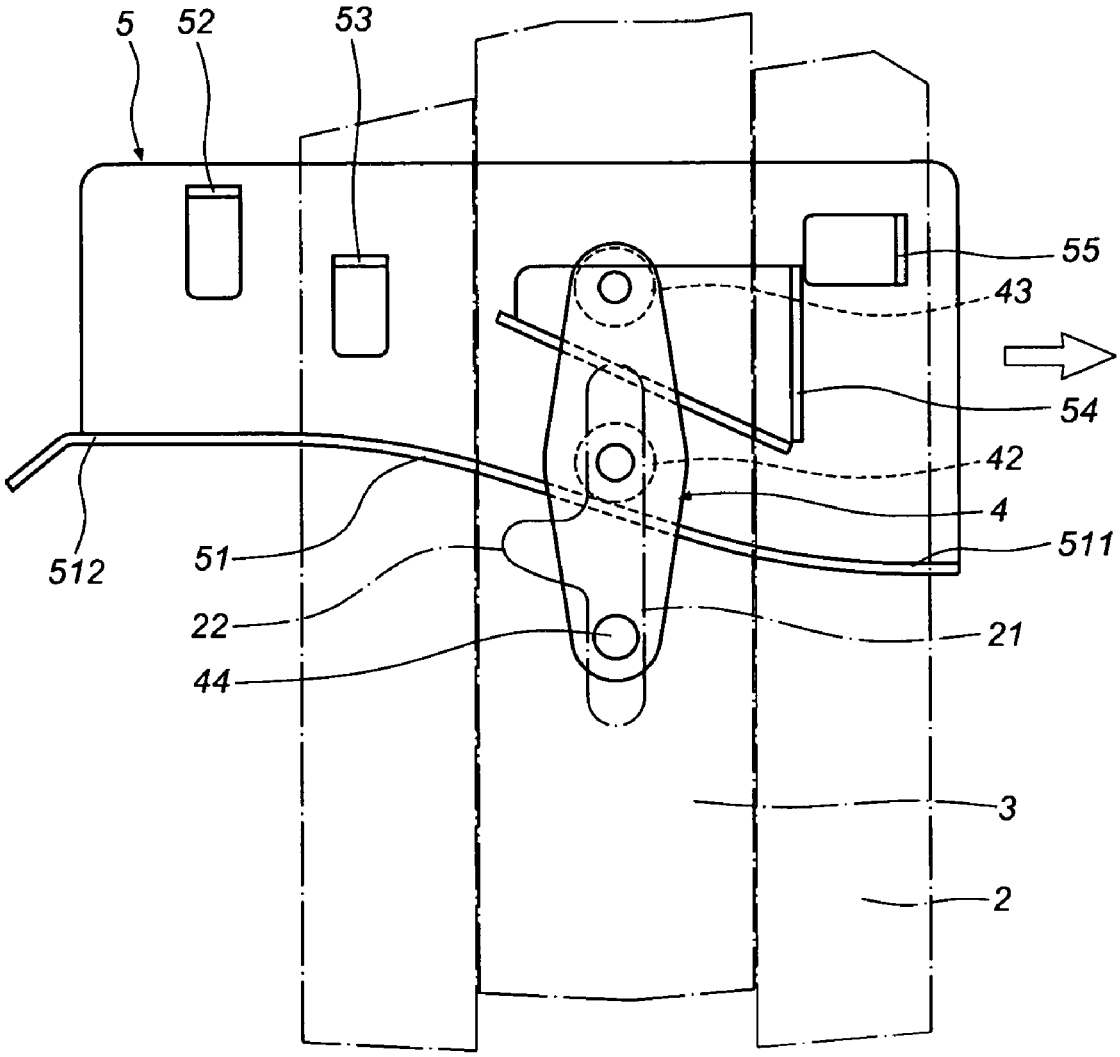
FIG. 5 is a view of a first operation of the present invention showing the positions of the fixture, the locking member and the guiding member of the present invention.
Figure 6:
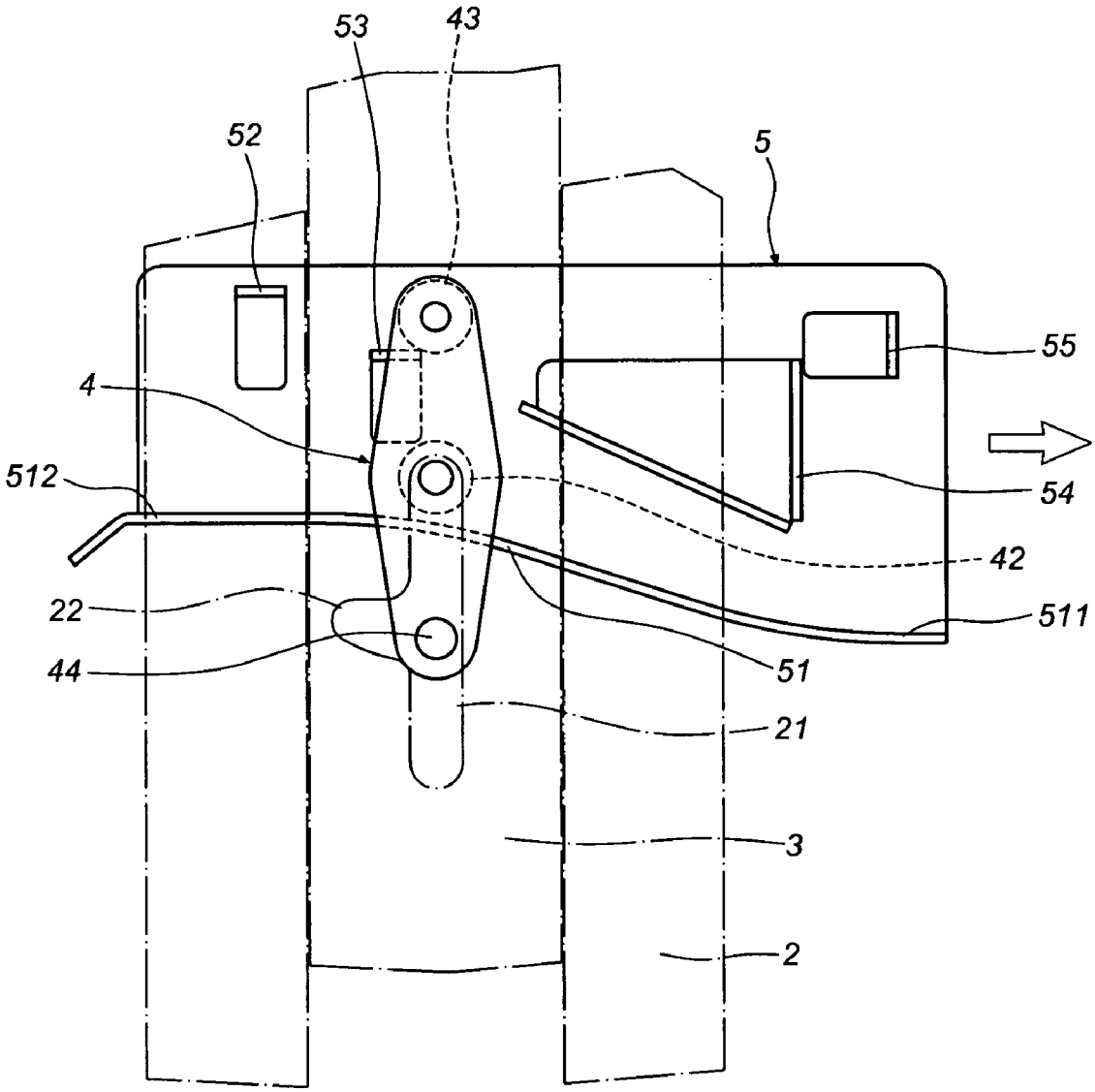
FIG. 6 is a view of a second operation of the present invention showing the positions of the fixture, the locking member and the guiding member of the present invention.

When one of the drawers 1 is open, as shown in FIGS. 5 and 6, the guiding member 5 of the open drawer 1 will be linked to slide. The guiding members 5 of the other drawers 1 remain still. The first end 511 of the guiding board 51 of the guiding member 5 of the open drawer 1 pushes the stick 42 of the relative locking member 4 to rise, which links the linking frame 3 to rise. While all of the locking members 4 are rising, the protuberances 44 also slide within the slots 21, other than the locking member 4 that corresponds to the guiding member 5 of the open drawer 1, the sticks 42 of the locking members 4 start to rise to the first blocking boards 54 of the relative guiding members 5.

Figure 7:
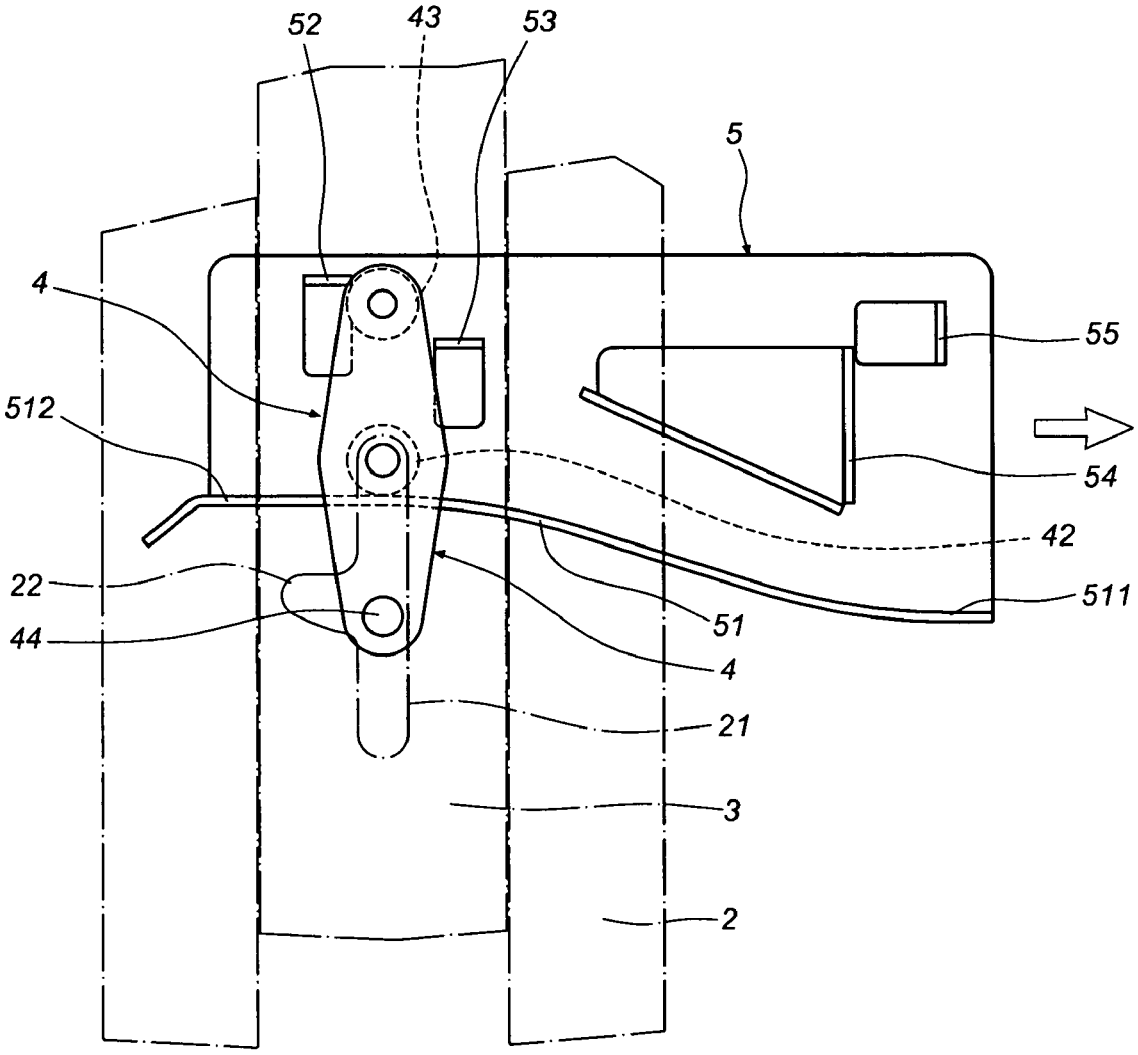
FIG. 7 is a view showing the fixture, the locking member and the guiding member in a first locked position.

As shown in FIGS. 7 and 8, when the stick 42 of the locking member 4 is pushed towards the second end 512 by the guiding board 51 of the guiding member 5 of the open drawer 1, the first clip 52 will engage with the upper section of the driven protuberance 43, which makes the locking member 4 to spin with respect to the stick 42. The protuberance 44 is slid into the locating trough 22 to secure the linking frame 3 temporarily. As shown in FIG. 9, the locking members 4 of the other drawers at this moment are moved to the highest point by means of the linking frame 3, and their driven protuberances 43 are located next to the second blocking boards 55 of the relative guiding members 5, thus the locking members 4 of the other drawers are unable to swing, and their protuberances 44 are unable to slide into the relative locating troughs 22, therefore, the sticks 42 of the locking members 4 block the first blocking boards 54, which means that the locking members 4 block the relative guiding members 5 to lock the other drawers 1.

To unlock the drawers 1 of the present invention, as shown in FIGS. 10 and 11, the returned guiding member 5 has its second clip 53 engaging with the lower section of the driven protuberance 43 of the locking member 4, which forces the locking member 4 to return to its original position, and the protuberance 44 is back to the slot 21 through the locating trough 22. Whereas the weight of the drawer 1 will force the linking frame 3 and the locking members 4 to return to their original positions, so that the other drawer 1 may be pulled to open afterward.

What is claimed is:

1. A drawer interlock mechanism, comprising:

at last two drawers, said drawers corresponding with each other in an upper and lower position and enabling to slide in and out;

a fixture, said fixture being disposed at one side of said drawers and having longitudinal slots, each said slot having a locating trough at a center portion thereof, said locating trough interconnecting with said slot;

a linking frame, said linking frame being disposed on said fixture and moving up and down with respect to said fixture;

locking members, said locking members being connected to said linking frame and corresponding in position to said slots of said fixture, each said locking member comprising a plate, a stick, a driven protuberance and a protuberance, said plate having a first end and a second end, said stick being pivoted to said plate and located between said first end and said second end of said plate, said plate being rotatable with respect to said stick, one end of said stick being fixedly connected to said linking frame, said driven protuberance being disposed on said first end of said plate and having an upper section and a lower section, said protuberance being disposed on said second end of said plate and sliding in said slot and said locating trough; and guiding members driven by said drawers, each said guiding member comprising a guiding board, a first clip, a second clip, a first blocking board, and a second blocking board, said guiding board having a lower first end and an upper second end and engaging with said stick of said locking member, said first clip and said second clip being spaced and located nearby said second end of said guiding board, said first clip engaging with said upper section of said driven protuberance of said locking member, said second clip engaging with said lower section of said driven protuberance of said locking member, said first blocking board and said second blocking board being disposed nearby said first end of said guiding board and corresponding in position to respective sides on top of said driven protuberance, when said locking member is linked by said linking frame to rise, said second blocking board blocking said driven protuberance to keep said locking member in a straight position with respect to said slot of said fixture, and said first blocking board blocking said stick of said locking member.

2. The drawer interlock mechanism, as recited in claim 1, wherein said guiding members are secured to the side of said drawers.

3. The drawer interlock mechanism, as recited in claim 1, wherein said drawers are mounted to a sliding device, said guiding members being secured to said sliding device.

* * * * *